US005905931A

United States Patent [19]

Shigeta et al.

[11] Patent Number: 5,905,931

[45] Date of Patent: May 18, 1999

[54] ELECTROPHOTOGRAPHIC IMAGE FORMING APPARATUS

[75] Inventors: Kunio Shigeta; Yotaro Sato; Satoshi Haneda; Hisayoshi Nagase, all of Hachioji; Toshihide Miura, Koganei, all of Japan

[73] Assignee: Konica Corporation, Tokyo, Japan

[21] Appl. No.: 09/067,397

[22] Filed: Apr. 28, 1998

[30] Foreign Application Priority Data

| | | | |
|---|---|---|---|
| May 12, 1997 | [JP] | Japan | 9-120548 |
| Jul. 10, 1997 | [JP] | Japan | 9-184970 |
| Sep. 24, 1997 | [JP] | Japan | 9-258046 |

[51] Int. Cl.[6] ..... G03G 15/16

[52] U.S. Cl. ..... 399/309; 399/302; 399/308

[58] Field of Search ..... 399/309, 308, 399/298, 302, 303, 66

[56] References Cited

U.S. PATENT DOCUMENTS

| | | | |
|---|---|---|---|
| 4,714,939 | 12/1987 | Ahern et al. | 399/309 |
| 5,027,159 | 6/1991 | Oda et al. | 399/309 |
| 5,070,372 | 12/1991 | Randall | 399/231 |
| 5,159,392 | 10/1992 | Kasahara et al. | 399/309 |
| 5,526,106 | 6/1996 | Katsumi et al. | 399/315 |
| 5,761,573 | 6/1998 | Haneda et al. | 399/66 |
| 5,799,226 | 8/1998 | Shigeta et al. | 399/66 |
| 5,822,666 | 10/1998 | Haneda et al. | 399/309 |
| 5,826,143 | 10/1998 | Haneda et al. | 399/309 X |

FOREIGN PATENT DOCUMENTS

| | | |
|---|---|---|
| 49-37538 | 10/1974 | Japan . |
| 54-28740 | 9/1979 | Japan . |
| 64-44457 | 2/1989 | Japan . |
| 4-214576 | 8/1992 | Japan . |

*Primary Examiner*—Matthew S. Smith
*Attorney, Agent, or Firm*—Frishauf, Holtz, Goodman, Langer & Chick

[57] ABSTRACT

An apparatus for forming toner images on both sides of a sheet includes a first transfer device which transfers a toner image from a rotatable image forming body onto a rotatable intermediate transfer member or onto the first side of a sheet; a second transfer device which transfers a toner image from the rotatable intermediate transfer member onto the second side of the sheet; and a fixing device which fixes the toner image on the first side of the sheet and the toner image on the second side of the sheet simultaneously. The sheet is conveyed to the first transfer device and to the second transfer device by the rotatable intermediate transfer member, is separated at a separating section from the rotatable intermediate transfer member, and is brought to the fixing device. The second transfer device is located between the first transfer device and the separating section, and a conductive member is located opposite the second transfer device.

15 Claims, 6 Drawing Sheets

FIG. 3 ( A )
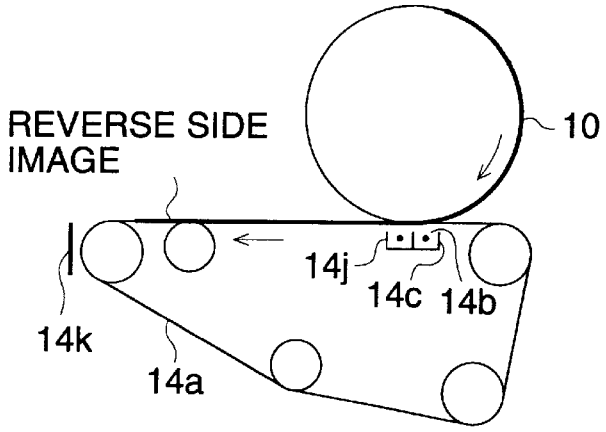
FIG. 3 ( B )
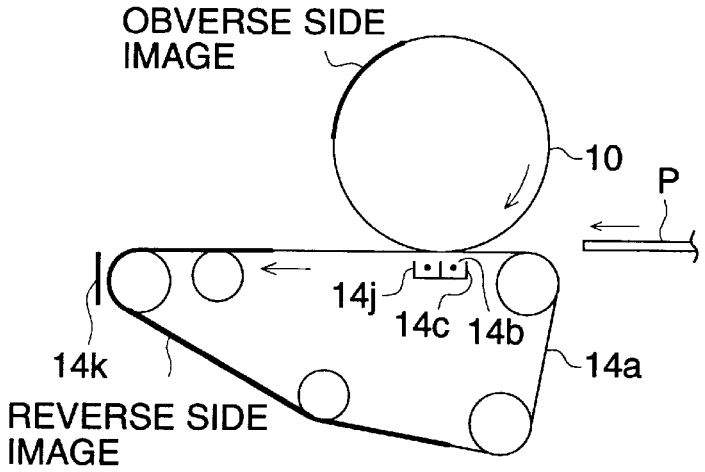
FIG. 3 ( C )
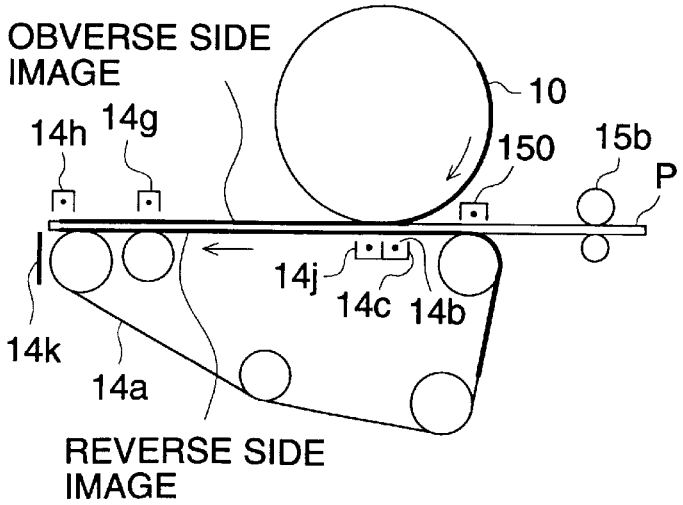

ELECTROPHOTOGRAPHIC IMAGE FORMING APPARATUS

BACKGROUND OF THE INVENTION

The present invention relates to an electrophotographic image forming apparatus such as a copying machine, a printer and a FAX (facsimile telegraph) wherein an image forming body is surrounded by a charging means, an image writing means and a developing means, and a toner image formed on the image forming means is transferred onto and fixed on a transfer material.

In two-sided image forming, there has so far been employed a method wherein an image on one side of a document formed on an image forming body is transferred and fixed on a transfer material which is then kept temporarily in an intermediate tray, and the transfer material is fed out of the intermediate tray in synchronization with an image formed next on the image forming body so that the image is transferred and fixed on the other side of the transfer material.

In the two-sided image forming apparatus of this type, conveyance operations for a transfer material such as conveyance thereof to an intermediate tray and conveying the transfer material through a fixing unit two times are conducted as stated above. Therefore, reliability for conveyance of the transfer material is low, resulting in causes for jamming and creases on the transfer material. For the situation mentioned above, TOKKOSHO Nos. 49-37538 and 54-28740 and TOKKAIHEI Nos. 1-44457 and 4-214576 are suggesting an image forming apparatus wherein toner images are formed on both sides of a transfer material and then they are fixed at the same time.

Further, the inventors of the invention are studying two-sided image forming by making and using an image forming apparatus wherein there is arranged a toner image forming means composed of a charging means, an image writing means and a developing means arranged around an image forming body (photoreceptor drum), and toner images formed on the image forming body are temporarily transferred onto a belt-shaped intermediate transfer body (a toner image receiving body) by the first transfer means, then, toner images are formed on the image forming body again, and the first transfer means transfers the toner images on the image forming body on one side of a transfer material conveyed on the intermediate transfer body as an obverse side image, while the second transfer means transfers the toner images on the intermediate transfer body on the other side of the transfer material as a reverse side image, and after that, the transfer material is neutralized by a transfer material separating means to be separated from the intermediate transfer body, thus toner images on the transfer material are fixed for two-sided image forming.

However, when an intermediate transfer body having low volume resistivity is used in the image forming apparatus mentioned above, the intermediate transfer body is struck by arcing of the second transfer means or the transfer material separating means before and behind or at both sides of the transfer material, and the intermediate transfer body is damaged, resulting in image defect of the reverse side image and transfer trouble of the obverse side image, which are the problems. On the other hand, when the intermediate transfer body having the high volume resistivity is used, electric charges on the intermediate transfer body charged by the second transfer means do not leak before arriving at the separating position of the transfer material, and thereby the transfer material after being subjected to transferring by the second transfer means is electrostatically attracted to the intermediate transfer body firmly, which causes a problem of difficult separation. For that reason, a transfer material separating means is provided at the position where a transfer material is separated from an intermediate transfer body, but when the second transfer means and the transfer material separating means are intended to be provided to face a roller that is located at the separation position to spread the intermediate transfer body, it is necessary to make the second transfer means and the transfer material separating means to be small in size. Therefore, electric discharge of both the second transfer means and the transfer material separating means is made insufficient, or the second transfer means and the transfer material separating means need to be arranged closely each other, which causes problems that electric discharge of the second transfer means and that of the transfer material separating means interfere, or transfer of toner images from the intermediate transfer body to the reverse side of the transfer material and separation of the transfer material from the intermediate transfer body are not carried out stably.

In addition, when the second transfer means is arranged in the vicinity of the separation position, transfer of the reverse side image conducted by the second transfer means is affected by how the transfer material is separated from the intermediate transfer body, regardless of whether the transfer material separating means is present or not, which causes problems that transfer of toner images from the intermediate transfer body to the reverse side of the transfer material can not be carried out stably, and in particular, the reverse side image is disturbed or transfer trouble happens at the trailing edge of the transfer material.

SUMMARY OF THE INVENTION

An object of the invention is to solve the problems mentioned above, and to provide an image forming apparatus wherein an intermediate transfer body is not damaged, and transfer of toner images onto the reverse side of a transfer material and separation of the transfer material from the intermediate transfer body can be carried out stably.

The object mentioned above can be achieved by an apparatus for forming toner images on both sides of a sheet, comprising:

a rotatable image forming body;

toner image forming means for forming the toner images on the rotatable image forming body;

a rotatable intermediate transfer member onto which a toner image is transferred;

first transfer means, located opposite the rotatable image forming body at a first transfer section, for transferring a toner image from the rotatable image forming body onto the rotatable intermediate transfer member or onto the first side of the sheet;

second transfer means, located opposite the rotatable intermediate transfer member at a second transfer section, for transferring the toner image from the rotatable intermediate transfer member onto the second side of the sheet;

fixing means for fixing the toner image on the first side and the toner image on the second side of the sheet simultaneously;

wherein the sheet is conveyed to the first transfer section and to the second transfer section by the rotatable intermediate transfer member, is separated at a separating section from the rotatable intermediate transfer member, and is brought into the fixing means, wherein the second transfer section is located between the first transfer section and the separating section, and wherein a conductive member is located opposite the second transfer means.

Further, the above object also can be achieved by the following preferable structure of an image forming apparatus.

An image forming apparatus comprises therein a toner image forming means which forms a toner image on the image forming body, an intermediate transfer body representing a means onto which the toner image on the image forming body can be transferred and which can convey a transfer material, the first transfer means which transfers the toner image on the image forming body onto the intermediate transfer body or the obverse side of the transfer material, the second transfer means which transfers the toner image on the intermediate transfer body onto the reverse side of the transfer material, and a fixing means which fixes the toner images on the transfer material, wherein a conductive rotary roller is provided at each of the position where the transfer material is separated from the intermediate transfer body and the position to face the second transfer means through the intermediate transfer body, and when L1 represents a distance between the position of the center of the rotary roller provided at the position where the transfer material is separated from the intermediate transfer body and the position of the center of the rotary roller provided at the position to face the second transfer means through the intermediate transfer body, and L2 represents a distance between the position of the center of the rotary roller provided at the position to face the second transfer means and the first transfer means, the distance L2 is made to be 20 mm or more and the relation of $L1 \geqq L2$ is satisfied.

An image forming apparatus comprises therein a toner image forming means which forms a toner image on the image forming body, an intermediate transfer body representing a means onto which the toner image on the image forming body can be transferred and which can convey a transfer material, the first transfer means which transfers the toner image on the image forming body onto the intermediate transfer body or the obverse side of the transfer material, the second transfer means which transfers the toner image on the intermediate transfer body onto the reverse side of the transfer material, and a fixing means which fixes the toner images on the transfer material, the volume resistivity of the intermediate transfer body is made to be $10^{10}$–$10^{16}\Omega\cdot$cm, and a conductive rotary roller is provided at each of the position to face the second transfer means through the intermediate transfer body and the position where the transfer material is separated from the intermediate transfer body.

A two-sided image forming apparatus comprises therein the first transfer process to move toner images for a reverse side image formed on the first image carrying means to a belt-shaped second image carrying means, the second transfer process to transfer toner images for an obverse side image formed on the first image carrying means onto the obverse side of the transfer material by interposing the second image carrying means, and the third transfer process to transfer the toner images for the reverse side image on the second image carrying means in the first transfer process onto the reverse side of the transfer material, wherein the volume resistivity of the second image carrying means is $10^{12}$–$10^{15}\Omega\cdot$cm, and the first and second transfer processes are conducted by movement of the toner images for a reverse side image formed on the first image carrying means to the second image carrying means, or by the first transfer means to transfer the toner images for an obverse side image formed on the first image carrying means onto the obverse side of the transfer material and the second image carrying means neutralizing means which neutralizes the second image carrying means.

BRIEF DESCRIPTION OF THE DRAWINGS

FIGS. 3(A) to 3(C) are diagrams showing how toner images are formed in the image forming apparatus of the invention.

DETAILED DESCRIPTION OF THE PREFERRED EMBODIMENT

An embodiment of the invention will be explained as follows. Description in this section does not limit the technical scope and meanings of terminology in the claims, and the conclusive explanation below shows the best mode and does not limit the technical scope and meanings of terminology in the invention. In the explanation of the following embodiment, the surface of a transfer material facing an image forming body in the transfer area is called an obverse side, while the surface on the other side of the transfer material, namely the surface of the transfer material facing an intermediate transfer body is called a reverse side, and an image to be transferred onto the obverse side of the transfer material is called an image for obverse side, and an image to be transferred onto the reverse side of the transfer material is called an image for reverse side.

Figure 1:
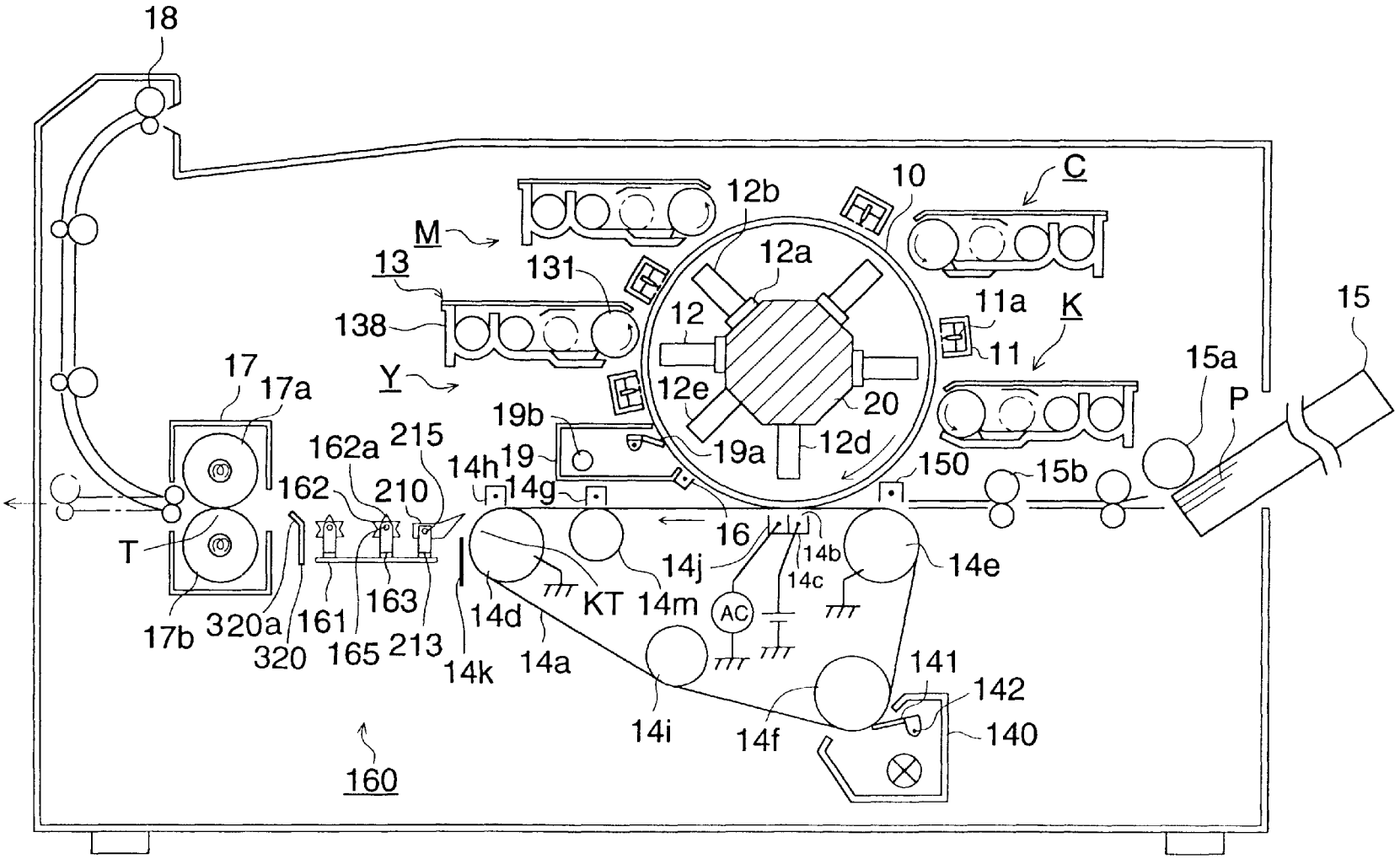
FIG. 1 is a sectional structure diagram of a color image forming apparatus showing an embodiment of the image forming apparatus of the invention.
Figure 2:
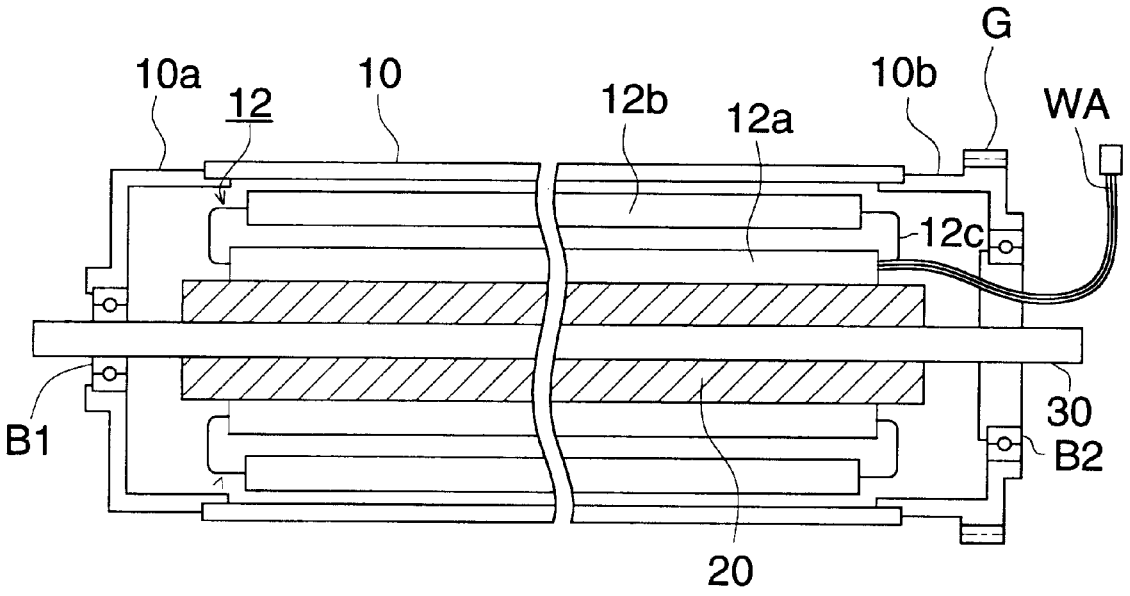
FIG. 2 is a side sectional view of an image forming body in FIG. 1.
Figure 4:
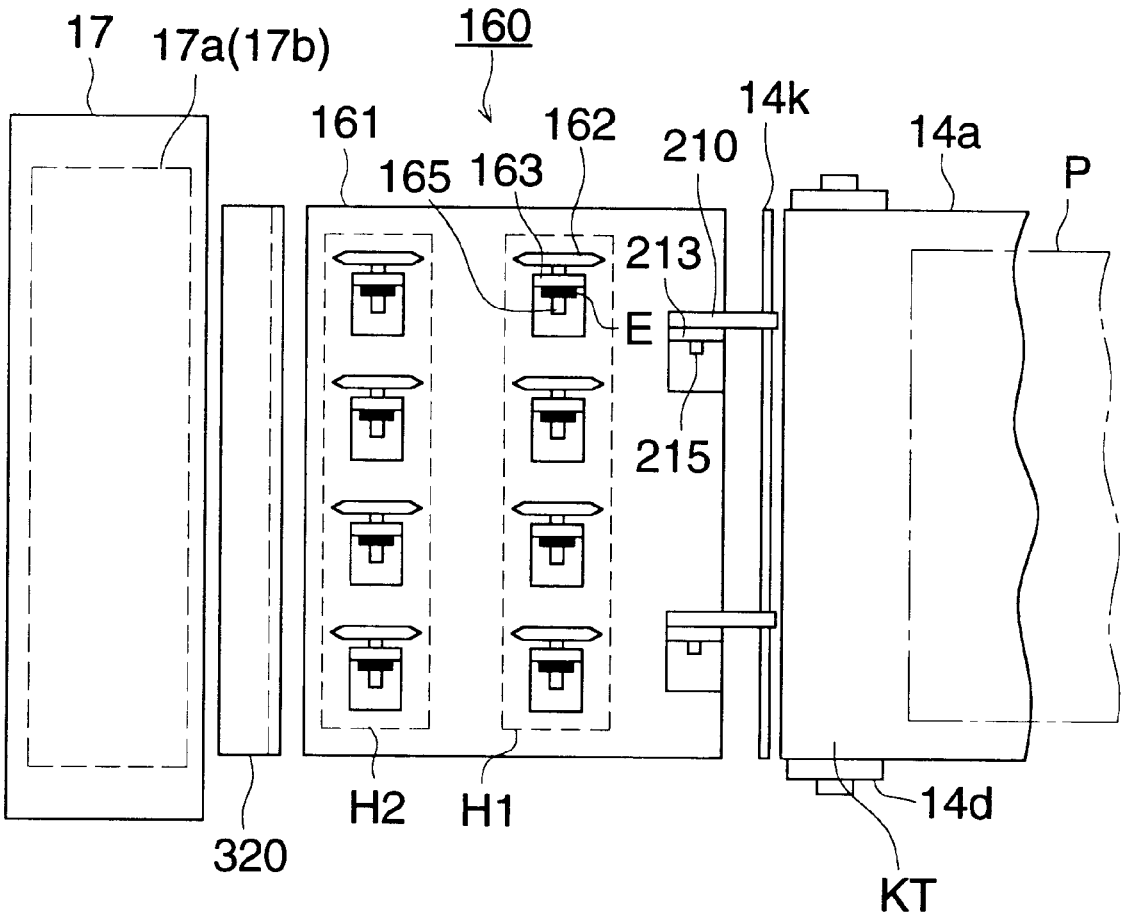
FIG. 4 is a diagram showing a conveyance section provided between an intermediate transfer body and a fixing means.

An image forming process and each structure of an embodiment of an image forming apparatus relating to the invention will be explained as follows, referring to FIGS. 1–4. FIG. 1 is a sectional structure diagram of a color image forming apparatus showing an embodiment of the image forming apparatus of the invention, and FIG. 2 is a side sectional view of an image forming body in FIG. 1. FIGS. 3(A)–3(C) are diagrams showing how toner images are formed in the image forming apparatus of the invention, wherein FIG. 3(A) is a diagram showing how toner images are formed when transferring reverse side images formed on the image forming body, while FIG. 3(B) is a diagram showing how toner images are formed when forming obverse side images on the image forming body in synchronization with the reverse side images on an intermediate transfer body, and FIG. 3(C) is a diagram two-sided image forming on the transfer material. FIG. 4 is a diagram showing a conveyance section provided between an intermediate transfer body and a fixing means.

In FIGS. 1 and 4, the numeral 10 represents a photoreceptor drum which is an image forming body, 11 represents a scorotron charging unit which is a charging means for each color, 12 represents an exposure optical system which is an image writing means for each color, 13 represents a developing unit which is a developing means for each color, 14*a* is a toner image receiving body which is an intermediate transfer body, 14*c* represents a primary transfer unit which is a first transfer means, 14*j* is a toner image receiving body neutralizing unit which is an intermediate transfer body neutralizing means, 14*g* represents a secondary transfer unit which is a second transfer means, the numeral 150 is a paper charging unit representing a transfer material charging means, 14*h* represents a sheet separation AC neutralizing unit which is a transfer material separation means, 14*k* represents neutralizing needle, 160 is a conveyance section having therein separation claw 210 representing a claw member and spurred wheels 162 representing spurred wheel member, 320 is a pressure roller shielding plate representing a shielding member, and 17 represents a fixing unit which is a fixing means.

Photoreceptor drum 10 which is an image forming body is one wherein a photosensitive layer such as a transparent conductive layer, an a—Si (amorphous silicon) layer or an organic photoconductor layer (OPC) is formed on an outer circumferential surface of a cylindrical base formed, for example, by a transparent member such as an optical glass or a transparent acrylic resin, and it is rotated in the clockwise direction shown with an arrow in FIG. 1 under the condition that its conductive layer is grounded.

Photoreceptor drum 10 is supported rotatably on drum shaft 30 which is fixed on the apparatus main frame through bearings B1 and B2 embedded respectively in flange member 10*a* and flange member 10*b* at both ends of the drum to engage with each other as shown in FIG. 2, and is rotated at constant speed in the prescribed direction when gear G united solidly with the flange member 10*b* is engaged with an unillustrated driving gear on the apparatus main frame to be driven. Inside the transparent base body of the photoreceptor drum 10, exposure optical system 12 representing an image writing means which will be described later is mounted on holding member 20 to be housed in the drum.

A toner image forming means which forms a toner image on the photoreceptor drum 10 representing an image forming body is composed of a charging means, an image writing means and a developing means. Scorotron charging unit 11 which is a charging means for each color, exposure optical system 12 which is an image writing means for each color, and developing unit 13 which is a developing means for each color are combined to be one set, and four sets of them are provided as image forming processes for yellow (Y), magenta (M), cyan (C) and black (K), and they are arranged in the order of Y, M, C and K for the rotation direction of the photoreceptor drum 10 shown with an arrow in FIG. 1.

Scorotron charging unit 11 which is a charging means for each color has therein a control grid kept at a prescribed voltage and discharge electrode 11*a* composed, for example, of saw-toothed electrodes, and it is mounted to face the photosensitive layer of the photoreceptor drum 10, so that it conducts charging operations (negative charging in the present example) through corona discharging in the same polarity as in toner and gives uniform voltage to the photoreceptor drum 10. As discharging electrode 11*a,* it is possible to use a wire electrode or an acicular electrode, in addition to the foregoing.

Exposure optical system 12 which is an image writing means for each color is arranged inside photoreceptor drum 10 in a way that the position of its exposure is located at the downstream side for the scorotron charging unit 11 for each color in the rotating direction of the photoreceptor drum 10. Each exposure optical system 12 is a unit for exposure composed of line-shaped exposure element 12*a* wherein there are arranged, in a form of an array, plural LEDs (light-emitting diodes) representing light-emitting elements for imagewise exposure light arranged in the primary scanning direction to be in parallel with drum shaft 30 as shown in FIG. 2, light-converging photo-transmitter (trade name: SELFOC lens array) serving as imaging element 12*b,* and a lens holder 12*c,* and it is mounted on holding member 20. On the holding member 20, there are mounted transfer-overlapping exposure unit 12*d* and unit for uniform exposure 12*e* in addition to the exposure optical system for each color 12, and they are integrally housed inside the transparent base of the photoreceptor drum 10. The exposure optical system 12 for each color conducts imagewise exposure on a photosensitive layer of the photoreceptor drum 10 from the reverse side of the photosensitive layer, in accordance with image data for each color which are read by a separate image reading unit and stored in a memory, so that an electrostatic latent image may be formed on the photoreceptor drum 10. As the exposure element 12*a,* is possible to use, in addition to the foregoing, those wherein plural light-emitting elements such as FL (phosphor luminescence), EL (electroluminescence), or PL (plasma discharge luminescence) are arranged in a form of an array. With regard to a wavelength of luminescence of a light-emitting element for imagewise exposure light, the wavelength in a range of 780–900 nm which is highly transmissive for Y, M and C toners is usually used, but it is also possible to use the shorter wavelength in a range of 400–780 nm which is not highly transmissive for color toners, because imagewise exposure is conducted from the reverse side in the present example. In FIG. 2, WA represents a lead wire coming from a light emitting diode (LED) for imagewise exposure light.

Developing unit 13 representing a developing means for each color has therein developing sleeve 131 which is made of cylindrical and non-magnetic stainless steel or aluminum material having a thickness of 0.5–1 mm and rotates in the same direction as that of the photoreceptor drum 10 while keeping a prescribed distance from the circumferential surface of the photoreceptor drum 10, and developing casing 138, and it houses therein single-component or two-component developing agent of yellow (Y), magenta (M), cyan (C) and black (K). Each developing unit 13 is kept, by an unillustrated stopper roller, to be away from the photoreceptor drum 10 by a prescribed distance, for example, by 100–500 $\mu$m on a non-contact basis, and it conducts non-contact reversal development to form a toner image on the photoreceptor drum 10 when developing bias voltage wherein DC voltage and AC voltage are superimposed is impressed on the developing sleeve 131.

Toner image receiving body 14*a* representing an intermediate transfer body is a seamless belt of a two-layer structure wherein fluorine coating with a thickness of 5–50 $\mu$m is preferably applied as a toner filming prevention layer on the outer side of a semi-conductive film base body having a thickness of 0.1–1.0 mm in which conductive materials are dispersed in engineering plastic such as denatured polyimide, thermosetting polyimide, ethylenetetrafluoroethylene copolymer, polyvinylidenefluoride, or nylon alloy. In addition to the foregoing, it is also possible to use, as a base body of the belt, a highly resistant rubber belt having a thickness of 0.3–2.0 mm wherein conductive materials are dispersed in silicone rubber or urethane rubber. It is preferable that the volume resistivity of the toner image receiving body 14*a* is $10^{10}$–$10^{16}\Omega\cdot$cm which means high resistance, and the volume resistivity of $10^{12}$–$10^{15}\Omega\cdot$cm is more preferable. When the resistance is lower than this resistance range, the toner image receiving body 14*a* tends to be struck by arcing of the second transfer means which will be stated later and of a transfer material separating means, at positions before and behind the transfer material or at both edges thereof, resulting in damage of the toner image receiving body 14*a*. When the resistance is too high, electric charges on the toner image receiving body 14*a* do not leak and neutralizing of the toner image receiving body 14*a* becomes difficult. Therefore, separability of recording sheet P is worsened, and exfoliation discharge is caused between the toner image receiving body 14*a* and photoreceptor drum 10 or between the toner image receiving body 14*a* and recording sheet P, which results in disturbance of toner images on the toner image receiving body 14*a* or on recording sheet P, and difficult cleaning of the toner image receiving body 14*a* caused by great adhesion of toner, which is a problem. Therefore, the range of resistance values satisfying transfer conditions and separation conditions is $10^{10}$–$10^{16}\Omega\cdot$cm and preferably is $10^{12}$–$10^{15}$.

The toner image receiving body 14*a* is trained about driving roller 14*d,* supporting roller 14*m,* driven roller 14*e,* guide roller 14*f* and tension roller 14*i,* to rotate in the counterclockwise direction shown with an arrow mark in FIG. 1. The driven roller 14*e,* supporting roller 14*m,* driving roller 14*d* and guide roller 14*f* are rotated at their fixed positions, while the tension roller 14*i* is movably supported by elastic force of an unillustrated spring to be rotated while giving tension to the toner image receiving body 14*a*. At an end portion of the toner image receiving body 14*a* on the part of fixing unit 17, curved portion KT is formed by the curvature of the driving roller 14*d* representing a roller member. Being driven by an unillustrated driving motor, the driving roller 14*d* is rotated and thereby the toner image receiving body 14*a* is driven to rotate. The supporting roller 14*m,* the driven roller 14*e,* the guide roller 14*f* and the tension roller 14*i* are driven by the rotation of the toner image receiving body 14*a* to rotate. Belt slack caused on the toner image receiving body 14*a* while it is rotating is removed by the tension roller 14*i*. Recording sheet P representing a transfer material is supplied to the position where the toner image receiving body 14*a* is stretched by the driven roller 14*e,* and then is attracted to the toner image receiving body 14*a* by a transfer material charging means which will be stated later to be conveyed, and the recording sheet P is separated.

Primary transfer unit 14*c* representing a first transfer means is a corona discharge unit provided to face the photoreceptor drum 10 with the toner image receiving body 14*a* serving as an in-between, so that it may form a transfer area 14*b* between the toner image receiving body 14*a* and the photoreceptor drum 10. When DC voltage whose polarity is opposite to that of toner (positive polarity in the present example) is impressed on the primary transfer unit 14*c,* b, the toner image on the photoreceptor drum 10 is transferred onto the toner image receiving body 14*a* or onto the obverse side of the recording sheet P representing a transfer material. In addition to the foregoing, it is also possible to use a conductive brush and a conductive roller which can be impressed with voltage, as the first transfer means.

Toner image receiving body neutralizing unit 14*j* representing an intermediate transfer material neutralizing means is a corona discharge unit which is provided at the downstream side of primary transfer unit 14*c* to be in parallel therewith in the rotary direction of the toner image receiving body 14*a* to face photoreceptor drum 10 with the toner image receiving body 14*a* serving as an in-between, and it is impressed with AC voltage on which DC voltage with polarity same as or opposite to that of toner is superposed at need, to neutralize the toner image receiving body 14*a*. In addition to the foregoing, it is also possible to use a conductive brush or a conductive roller which is grounded or is capable of being impressed with voltage as the intermediate transfer body neutralizing means. Without neutralizing operation by the toner image receiving body neutralizing unit 14*j,* when the volume resistivity of the toner image receiving body 14*a* is as high as $10^{10}$–$10^{16}\Omega\cdot$cm in terms of resistance, electric charges (electric charges with positive polarity in the present embodiment) accumulated by the primary transfer unit 14*c* on the toner image receiving body 14*a* discharge in the course of separation when transferring toner images on the photoreceptor drum 10 onto the toner image receiving body 14*a* or onto recording sheet P, thus, toner images are disturbed. Further, these uneven and accumulated electric charges caused by the discharge adversely affect also when reverse side images are transferred onto recording sheet P by secondary transfer unit 14*g* in the succeeding step. Since excessive electric charges accumulated on the toner image receiving body 14*a* are neutralized by neutralizing operation of the toner image receiving body neutralizing unit 14*j* in the invention, toner images transferred from the photoreceptor drum 10 onto the toner image receiving body 14*a* or onto recording sheet P are not disturbed, and transferring of toner images for reverse side images on the toner image receiving body 14*a* onto recording sheet P by the secondary transfer unit 14*g* is not adversely affected.

The secondary transfer unit 14*g* representing a second transfer means is preferably composed of a corona discharging unit and is provided to face supporting roller 14*m* representing a conductive rotary roller which is grounded across the toner image receiving body 14*a,* and is impressed with DC voltage whose polarity is opposite to that of toner (positive polarity in the present embodiment) to transfer toner images on the toner image receiving body 14*a* onto the reverse side of recording sheet P.

Sheet charging unit 150 representing a transfer material charging means is preferably composed of a corona discharging unit and is provided to face driven roller 14*e* which is grounded across the toner image receiving body 14*a,* and is impressed with DC voltage whose polarity is the same as that of toner (negative polarity in the present embodiment) to charge the recording sheet p so that it may be attracted to the toner image receiving body 14*a*. It is also possible to use a sheet-charging brush and a sheet-charging roller as the sheet-charging unit 150, in addition to a corona discharging unit.

Sheet separation AC neutralizing unit 14*h* representing a recording sheet separation means is preferably composed of a corona discharging unit and is provided on the end portion of toner image receiving body 14*a* on the fixing unit 17 side to face driving roller 14*d* representing a conductive rotary roller which is grounded across the toner image receiving body 14*a,* and is impressed with AC voltage in which DC voltage with polarity the same as or opposite to that of toner is superimposed to neutralize recording sheet P conveyed by the toner image receiving body 14*a* and thereby to separate the recording sheet P from the toner image receiving body 14*a*.

Neutralizing needle 14*k* is provided in the vicinity of curved portion KT between the end portion of the toner image receiving body 14*a* on the fixing unit 17 side and conveyance portion 160, and it leaks electric charges on toner images for a reverse side image on the recording sheet P, and assists the recording sheet P to be separated from the toner image receiving body 14*a,* and prevents adhesion of the recording sheet P to separation claw 210, spurred wheels 162, and an unillustrated transfer material guiding member.

Conveyance section 160 has separation claw 210 representing a claw member and spurred wheels 162 representing a spurred wheel member, and is provided between the curved portion KT of toner image receiving body 14*a* and fixing unit 17. By providing the conveyance section 160 between the toner image receiving body 14*a* and the fixing unit 17, it is possible to prevent problems that the toner image receiving body 14*a* is deformed by heat generated by the fixing unit 17, toner images for a reverse side image carried by the toner image receiving body 14*a* are slightly fused and become difficult to be transferred, and toner sticks on the toner image receiving body 14*a*.

The separation claw 210 representing a claw member is provided in the vicinity of curved portion KT of the toner image receiving body 14*a,* and is fixed to separation claw holder 213 representing a claw member supporting member which is provided at the upstream side of conveyance section 160 in the direction for conveying the recording sheet P. When the recording sheet P is separated from the toner image receiving body 14*a,* the separation claw 210 scoops out the recording sheet P from the curved portion KT by touching the leading edge of the recording sheet P which is to be conveyed along the curved portion KT of the toner image receiving body 14*a,* and thereby it supplements separation of the recording sheet P from the toner image receiving body 14*a*.

The separation claw 210 is positioned with adhesives to be fixed when supporting shaft 215 provided to be integrally with the separation claw 210 is mounted on the separation claw holder 213 mounted at the prescribed position of bottom plate 161 of conveyance section 160. As shown in FIG. 4, a plurality of separation claws 210 are located at the prescribed position on the bottom plate 161 to be in parallel in the direction perpendicular to the conveyance direction for the recording sheet P, namely, in the longitudinal direction of the fixing unit 17, so that the separation claws 210 may be away from the curved portion KT by the prescribed clearance of 0.1–2.0 mm, for example.

Spurred wheels 162 representing a spurred wheel member is mounted rotatably on spurred wheel holder 163 representing a spurred wheel member supporting member that is provided on bottom plate 161 of conveyance section 160, with the tip portion of rotation supporting shaft 165 that is provided integrally with the spurred wheels 162 having thereon an E-ring. The spurred wheels 162 scoop up the leading edge of the recording sheet P separated from the toner image receiving body 14*a* from the separation claw 210, and they convey the recording sheet P to the fixing unit 17, while guiding the reverse surface side of the recording sheet P with plural spur sections 162*a* provided around the circumferential surface of each spurred wheel, and thereby preventing disturbance of toner images on the reverse side.

As shown in FIG. 4, plural spurred wheels 162 are provided at the prescribed position on the bottom plate 161 to be in parallel in the direction perpendicular to the conveyance direction for the recording sheet P, namely, in the longitudinal direction of the fixing unit 17. Plural spurred wheels 162 constitute spurred wheels groups H1 and H2 each being in the direction perpendicular to the conveyance direction for the recording sheet P, and the number of the spurred wheels groups is one or more.

For the separation claw 210, the separation claw holder 213, the spurred wheels 162 and the spurred wheel holder 163, there are used resin moldings which are made of, for example, Teflon, polyimide, or polycarbonate resin, and having high resistance of not less than $10^{10}\Omega\cdot$cm or having insulating properties, or each of portions of the aforesaid members which comes in contact with or is close to the reverse side of the recording sheet P, namely, each of a tip portion or a top surface portion of the separation claw 21, the separation claw holder 213 and spur portions 162*a* of the spurred wheels 162, and spurred wheel holder 163 is covered with resin coating which is made of fluorine resin, for example, having high resistance of not less than $10^{10}\Omega\cdot$cm or having insulating properties. When the separation claw 210, the separation claw holder 213, the spurred wheels 162 and the spurred wheel holder 163 are covered with or constituted with semiconductive or insulating members, it is possible to prevent toner stains caused by electrostatic sticking of toner images for reverse side image to the aforesaid members, and to prevent occurrence of ring-pattern image defects of obverse side images considered to be caused by obverse side toner repelled by electric charges (with polarity which is opposite to that of reverse side toner and is the same as that of obverse side toner after polarity conversion) induced electrostatically by the reverse side toner, when grounding the separation claw 210, the separation claw holder 213, the spurred wheels 162 and the spurred wheel holder 163.

Pressure roller shielding plate 320 is made of doglegged rectangular sheet material, for example, and it is mounted at the prescribed position on the apparatus main body or on the fixing unit 17 to be in the direction perpendicular to the conveyance direction for the recording sheet P, namely, in the longitudinal direction of the fixing unit 17, with its guide portion 320*a* located on the side of the conveyance of the recording sheet P, so that the pressure roller shielding plate 320 blocks heat from the fixing unit 17, especially from pressure roller 17*b* on the part of the reverse side.

For the pressure roller shielding plate 320, there are used resin moldings which are made of, for example, Teflon, polyimide, or polycarbonate resin, and having high resistance of not less than $10^{10}\Omega\cdot$cm or having insulating properties, or they are covered with a resin coating which is made of fluorine resin, for example, having high resistance of not less than $10^{13}\Omega\cdot$cm or having insulating properties. When the pressure roller shielding plate 320 is covered with or constituted with semiconductive or insulating member, electric charges are not induced on the pressure roller shielding plate 320, and it is possible to prevent toner stains caused by electrostatic sticking of toner images for reverse side image to the pressure roller shielding plate 320, and to prevent occurrence of ring-pattern image defects considered to be caused by obverse side toner repelled by electric charges (with polarity which is opposite to that of reverse side toner and is the same as that of obverse side toner after polarity conversion) induced electrostatically by the reverse side toner, when grounding the pressure roller shielding plate 320, Fixing unit 17 representing a fixing means is composed of a fixing member rotating as a pair of fixing roller 17*a* representing a fixing member on the obverse side (upper side) having therein a heater and fixing roller 17*b* representing a fixing member on the reverse side (lower side), and toner images on recording sheet P are fixed by heat and pressure both applied to the toner images when the recording sheet P is nipped by a pressure contact portion (nip portion) between the fixing roller 17*a* and the pressure roller 17*b*.

Next, the image forming process will be explained below.

When image recording is started, an unillustrated photoreceptor driving motor is started, and it rotates photoreceptor drum 10 in the clockwise direction shown with an arrow in FIG. 1. Concurrently with this, scorotron charging unit 11 for yellow (Y) starts its charging operation to give voltage to the photoreceptor drum 10.

After being given voltage, the photoreceptor drum 10 is subjected to image writing conducted by exposure optical system 12 for Y in accordance with electric signals corresponding to the image data for the first color signal, namely for Y, and an electrostatic latent image corresponding to the image for Y in the original image is formed on the surface of the photoreceptor drum 10.

The latent image mentioned above is subjected to reversal development conducted by developing unit 13 for Y on a non-contact basis, and thereby a toner image for yellow (Y) is formed on the photoreceptor drum 10.

Then, voltage is given on the toner image for Y on the photoreceptor drum 10 by charging operation of scorotron charging unit 11 for magenta (M), and the photoreceptor drum 10 is subjected to image writing conducted by exposure optical system 12 for M in accordance with electric signals corresponding to the image data for the second color signal, namely for M, thus, the toner image for magenta (M) is formed to be superposed on the toner image for yellow (Y) mentioned above through non-contact reversal development conducted by developing unit 13 for M.

In the same process as in the foregoing, a toner image for cyan (C) corresponding to the third color is formed to be superposed by scorotron charging unit 11 for cyan (C), exposure optical system 12 for C and developing unit 13 for C, and on that toner image, a toner image for black (K) corresponding to the fourth color is formed to be superposed in succession by scorotron charging unit 11 for black (K), exposure optical system 12 for K and developing unit 13 for K. Thus, the superposed color toner images of four colors of yellow (Y), magenta (M), cyan (C) and black (K) are formed on the circumferential surface of the photoreceptor drum 10 within its one turn (toner image forming means).

Image writing conducted by each of exposure optical systems 12 for Y, M, C and K on the photosensitive layer of the photoreceptor drum 10 is carried out through a transparent base from the inside of the drum. Therefore, image writing for the second, third and fourth color signals can be conducted without being affected by the toner image formed in the preceding step, and electrostatic latent images for them which are the same as the image corresponding to the first color signal can be formed accordingly.

Toner images for a reverse side image formed by the aforesaid image forming process on the photoreceptor drum 10 which is an image forming body are collectively transferred, at transfer area 14*b*, onto toner image receiving body 14*a* representing an intermediate transfer body by primary transfer unit 14*c* representing a first transfer means, and the toner image receiving body 14 is neutralized by toner image receiving body neutralizing unit 14*j* representing an intermediate transfer body neutralizing means (FIG. 3(A)). In this case, it is also possible to arrange so that uniform exposure may be carried out for excellent transfer by transfer-overlapping exposure unit 12*d* provided inside the photoreceptor drum 10.

Toner remaining on the circumferential surface of the photoreceptor drum 10 after transfer goes to cleaning unit 19 representing an image forming body cleaning means, after being subjected to neutralizing performed by photoreceptor drum AC neutralizing unit 16, then is removed by cleaning blade 19*a* which is made of rubber material and is in contact with the photoreceptor drum 10, and is collected in an unillustrated waste toner container by screw 19*b*. The circumferential surface of the photoreceptor drum 10 is subjected to exposure conducted by pre-charging uniform exposure unit 12*e* employing, for example, light-emitting diodes, so that hysteresis of the photoreceptor drum 10 caused by the preceding image forming may be eliminated.

After the superposed color toner images which are to be a reverse side image are formed on the toner image receiving body 14*a* in the aforesaid way, the superposed color toner images for an obverse side image are formed on the photoreceptor drum 10 in the same way as in the aforesaid color image forming process (FIG. 3(B)). In this case, image data are changed so that images for obverse side formed on the photoreceptor drum 10 may represent a reflected image for the image for reverse side formed on the photoreceptor drum 10.

Along with formation of an image for obverse side on the photoreceptor drum 10, recording sheet P is fed out of sheet-feeding cassette 15 which is a recording sheet storing means by feed-out roller 15*a*, then is conveyed to timing roller 15*b* representing a recording sheet feeding means, and is conveyed to transfer area 14*b* by the timing roller 15*b*, with color toner images for a reverse side image formed on the photoreceptor drum 10 and color toner images for a reverse side image carried on the toner image receiving body 14*a* both of which are synchronized each other. In this case, the recording sheet P thus fed is charged by sheet-charging unit 150 representing a transfer material charging means which is provided on the obverse side of recording sheet P to be of the same polarity as of toner, and is attracted to the toner image receiving body 14*a* to be fed to transfer area 14*b*. By sheet-charging the recording sheet P to be of the same polarity as that of toner, the recording sheet P is prevented from attracting toner images on the toner image receiving body 14*a* and toner images on the photoreceptor drum 10, whereby disturbance of toner images is prevented. Voltage is impressed on sheet-charging unit 150 representing a transfer material charging means only when the recording sheet P is being conveyed, and impression of voltage on the sheet-charging unit 150 is cut simultaneously with the passage of the recording sheet P.

In the transfer area 14*b*, images for obverse side on the photoreceptor drum 10 are collectively transferred onto the obverse side of the recording sheet P by primary transfer unit 14*c* serving as a first transfer means which is to be impressed with voltage having polarity opposite to that of toner (positive polarity in the present example), and the toner image receiving body 14*a* is neutralized by toner image receiving body neutralizing unit 14*j* representing an intermediate transfer body. In this case, images for reverse side on the toner image receiving body 14*a* are not transferred onto the recording sheet P and stay on the toner image receiving body 14*a*. In the case of transfer by means of transfer unit 14*c*, it is also possible to arrange so that uniform exposure may be carried by transfer-overlapping exposure unit 12*d* which employs light-emitting diode, for example, and is provided inside the photoreceptor drum 10 to face the transfer area 14*b*, so that excellent transfer can be carried out.

In the foregoing, it is preferable that an absolute value of a transfer electric current for primary transfer unit 14*c* in the course (which is called the second transfer step) of transfer of toner images formed on the photoreceptor drum 10 onto the obverse side of recording sheet P conveyed by the toner image receiving body 14*a* is made to be greater than that of a transfer electric current for primary transfer unit 14*c* in the course (which is called the first transfer step) of transfer of toner images formed on the photoreceptor drum 10 onto the toner image receiving body 14*a*. As a transfer electric current for the first transfer unit 14*c* in the first transfer step, a transfer electric current of 10–200 μA (with positive polarity which is opposite to that of toner in the present embodiment) is usually used depending on the linear speed of photoreceptor drum 10, and it is preferable that an absolute value of a transfer electric current for the primary transfer unit 14*c* in the second transfer step is (1.2–1.7) times that of a transfer electric current for the primary transfer unit 14*c* in the first transfer step or more. In the case of less than 1.2 times, toner images for the obverse side image are not transferred onto recording sheet P properly in the second transfer step, while in the case of more than 1.7 times, an electric current is too great and toner images for the obverse side image are disturbed. Since accumulated electric charges are also increased as the transfer electric current is increased, a neutralizing electric current for toner image receiving body neutralizing unit 14*j* after the second transfer step is made to be greater than that for toner image receiving body neutralizing unit 14*j* after the first transfer step.

The recording sheet P having on its obverse side the transferred color toner images is conveyed to secondary transfer unit 14*g* serving as a second transfer means, and the toner images for reverse side formed on the circumferential surface of the toner image receiving body 14*a* are collectively transferred, as the third transfer step, onto the reverse side of the recording sheet P by secondary transfer unit 14*g* on which voltage with polarity opposite to that of toner (positive polarity in the present embodiment) is impressed (FIG. 3 (C)).

The recording sheet P having on its both sides color toner images formed is separated from the toner image receiving body 14*a* by curved portion KT of toner image receiving body 14*a*, neutralizing operation of neutralizing needle 14K, neutralizing operation conducted by sheet separation AC neutralizing unit 14*h* representing a recording sheet separating means provided, at need, at the end portion of the toner image receiving body 14*a*, and separation claw 210 provided to be away from the toner image receiving body 14*a* by a prescribed distance and is conveyed to fixing unit 17 which is a fixing means through spurred wheels 162 by being prevented, by neutralizing operation of the neutralizing needle 14K, from adhering to separation claw 210 and to spurred wheels 162, and toner images on the recording sheet P are fixed when heat and pressure are applied on the recording sheet P when it is nipped in the nip portion T between fixing roller 17*a* and pressure roller 17*b* both representing a fixing member on both sides rotating as a pair. The recording sheet P which has been subjected to two-sided image recording is reversed upside down and is ejected to a tray outside an apparatus by ejection roller 18. As shown with one-dot chain lines in FIG. 1, it is also possible to provide an unillustrated switching member at an outlet of the fixing unit 17 so that the recording sheet P can be ejected to a tray outside the apparatus without being reversed.

Toner remaining on the surface of the toner image receiving body 14*a* after transfer is removed by toner image receiving body cleaning unit 140 which is provided to face guide roller 14*f* across the toner image receiving body 14*a* and is an intermediate transfer body cleaning means having toner image receiving body cleaning blade 141 capable of touching and being separated from the toner image receiving body 14*a* on supporting shaft 142 serving as a fulcrum.

The photoreceptor drum 10 after transfer is neutralized by photoreceptor drum AC neutralizing unit 16, and then is cleaned by cleaning unit 19 to be free from toner remaining on the circumferential surface, and hysteresis of the photoreceptor drum 10 caused by the preceding image forming is eliminated by pre-charging uniform exposure unit 12*e* to enter the following image forming cycle.

When the method mentioned above is used, superposed color toner images can be collectively transferred, and therefore, color-doubling of color images on the toner image receiving body 14*a*, and toner scattering and scrubbing are hardly caused, thus, excellent two-sided color image forming with less image deterioration can be carried out.

Though a color image forming apparatus has been explained as an embodiment of the aforesaid image forming apparatus, the invention is not limited to this, and the invention can also be applied to a monochromatic image forming apparatus with a process identical to that explained in FIG. 1.

Further, in the image forming apparatus of the invention, it is naturally possible to conduct a single-sided image forming wherein an image is formed only on a single side such as an obverse side or a reverse side of a transfer material, in addition to two-sided image forming wherein images are formed on both sides of a transfer material as explained in the aforesaid embodiment.

Figure 5:
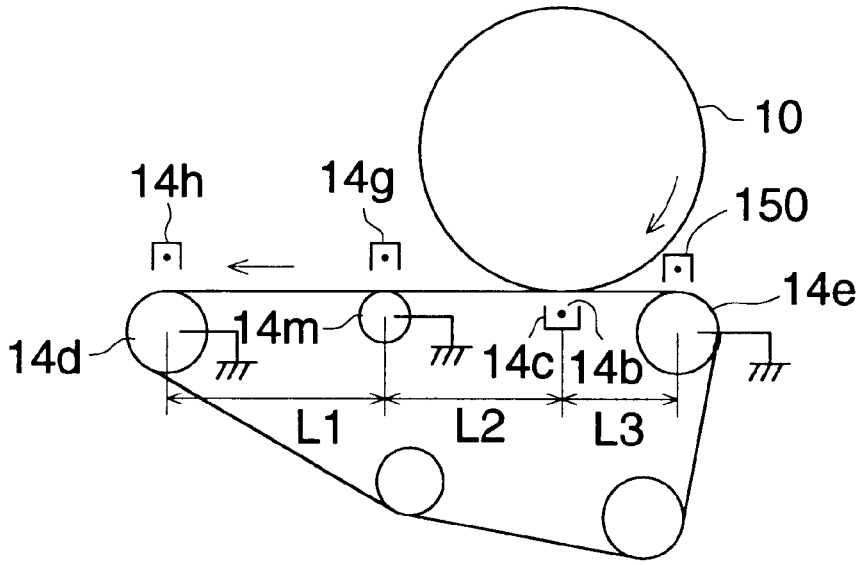
FIG. 5 is a diagram showing the positional relation between a rotary roller provided to face the first transfer means and the second transfer means and a rotary roller provided at the position where a transfer material is separated from an intermediate transfer body.

In the aforesaid embodiment, both of driving roller 14*d* and supporting roller 14*m* are represented by a grounded conductive rotary roller as shown in FIG. 5, wherein the supporting roller 14*m* faces secondary transfer unit 14*g* across toner image receiving body 14*a* representing an intermediate transfer body, while the driving roller 14*d* faces sheet separation AC neutralizing unit 14*h*, and the secondary transfer unit 14*g* and the sheet separation AC neutralizing unit 14*h* are arranged to be away from each other by the prescribed distance. When each of the secondary transfer unit 14*g* and the sheet separation AC neutralizing unit 14*h* is provided with a grounded conductive rotary roller through which a discharge electric current flows, interference between discharge of the secondary transfer unit 14*g* and that of the sheet separation AC neutralizing unit 14*h* is prevented, and discharge of each of them can be stabilized. Further, when the second transfer means and a separation position are arranged to be away from each other by a certain distance, transfer of reverse side toner image conducted by the second transfer means is not affected by how recording sheet P is separated in the separation position, resulting in the stable transferring, and the transfer material can be separated easily at the separation position. Further, when a grounded conductive member facing the secondary transfer unit 14*g* is made to be the supporting roller 14*m* representing a rotary roller, strong electrostatic force acts between the toner image receiving body 14*a* and the grounded conductive member in the case of discharge of the secondary transfer unit 14*g*, and the toner image receiving body 14*a* comes in close contact with the conductive member, eliminating the problem of unstable conveyance.

When L1 represents a distance between a center position of driving roller 14*d* representing a conductive rotary roller provided at the position where recording sheet P is separated from toner image receiving body 14*a* and a center position of supporting roller 14*m* representing a conductive rotary roller provided at the position to face secondary transfer unit 14*g* representing the second transfer means through the toner image receiving body 14*a,* L2 represents a distance between a center position of the supporting roller 14*m* and a position of primary transfer unit 14*c* representing the first transfer means, and L3 represents a distance between a position of the transfer unit 14*c* and a center position of driven roller 14*e* representing a rotary roller provided at the position to face sheet charging unit 150 representing a transfer material charging means through the toner image receiving body 14*a* representing an intermediate transfer body, it is preferable that each of distances L1, L2 and L3 is 20 mm or more. Due to this, interference of electric discharge between sheet separation AC neutralizing unit 14*h* and secondary transfer unit 14*g,* interference of electric discharge between the secondary transfer unit 14*g* and primary transfer unit 14*c,* and interference of electric discharge between the primary transfer unit 14*c* and sheet charging unit 150 are prevented.

It is preferable that the distance L1 is made to be not less than L2 (L1≧L2), and electric charges on recording sheet P which are electrostatically attracted firmly to toner image receiving body 14*a* in the course of transfer by secondary transfer unit 14*g* and those on recording sheet P which are charged in the course of transfer by the secondary transfer unit 14*g* are caused to leak before they arrive at the separation position, and it is also preferable that the distance L1 between the center position of driving roller 14*d* and that of supporting roller 14*m* is in the range of 20 mm–200 mm. When the distance L1 is less than 20 mm, electric charges charged on toner image receiving body 14*a* by secondary transfer unit 14*g* do not leak before they arrive at the separation position where sheet separation AC neutralizing unit 14*h* is provided, which makes it difficult for the recording sheet P to be separated, while when the distance L1 exceeds 200 mm, close adhesion between the recording sheet P and the toner image receiving body 14*a* is worsened and reverse side images are disturbed. Incidentally, driving roller 14*d* having an outside diameter of 10–40 mm and supporting roller 14*m* having an outside diameter of 6–20 mm are usually used.

In the range of volume resistivity of toner image receiving body 14*a* explained below, it is further preferable that the distance L1 between the center position of the driving roller 14*d* and that of the supporting roller 14*m* is in the range of 20 mm–200 mm.

As stated above, the volume resistivity of the toner image receiving body 14*a* representing an intermediate transfer body is $10^{10}$–$10^{16}$Ω·cm. When the volume resistivity is less than $10^{10}$Ω·cm, the toner image receiving body 14*a* is struck by arcing of secondary transfer unit 14*g* and sheet separation AC neutralizing unit 14*h* both facing the grounded conductive rotary roller, and the toner image receiving body 14*a* is damaged. When the volume resistivity exceeds $10^{16}$Ω·cm, electric charges on the toner image receiving body 14*a* charged by the second transfer unit 14*g* do not leak before they arrive at the separation position where the sheet separation AC neutralizing unit 14*h* is provided, which makes the separation to be difficult.

Since electric charges can leak sufficiently under the condition that distance L1 between the center position of driving roller 14*d* and that of supporting roller 14*m* is 20 mm or more, when the volume resistivity of the toner image receiving body 14*a* is $10^{10}$–$10^{16}$Ω·cm and a moving speed of the toner image receiving body 14*a* is in the range of 50–500 mm/sec, it is also possible to omit the sheet separation AC neutralizing unit 14*h* by making an outside diameter of the driving roller 14*d* to be a small diameter which is as small as 10–20 mm. It is possible to accelerate leakage of electric charges further by providing, between the driving roller 14*d* and the supporting roller 14*m,* a grounded conductive brush or the like to be inscribed in the toner image receiving body 14*a*. When the distance L1 is not more than 200 mm, close adhesion between the recording sheet P and the toner image receiving body 14*a* is not worsened and reverse side images are not disturbed.

Under the condition that a value of the volume resistivity of an intermediate transfer body is established as stated above, the intermediate transfer body is not damaged, and electric charges on the intermediate transfer body charged by the second transfer means are leaked before they arrive at the separation position, which makes a transfer material to be separated easily.

Figure 6:
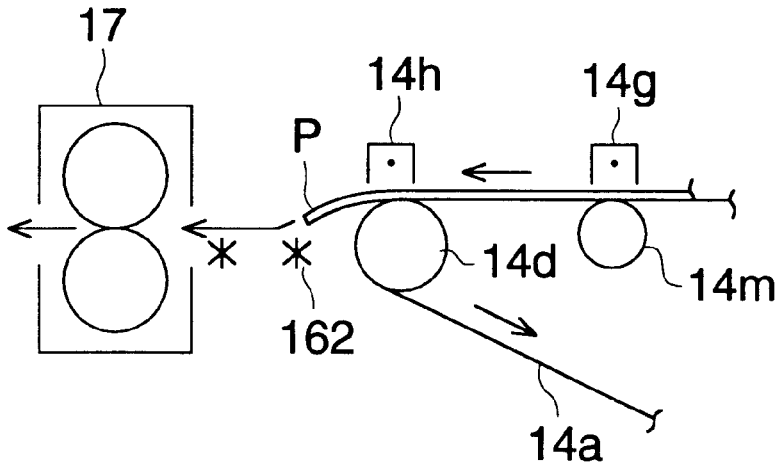
FIG. 6 is a diagram showing how a transfer material is led to a fixing means by a spurred wheel.

By setting a value of the volume resistivity of the toner image receiving body 14*a* representing an intermediate transfer body to a prescribed value and providing a conductive rotary roller at each of the position to face the second transfer means and the separation position as stated above, separation of the recording sheet P representing a transfer material can be stabilized. However, when the recording sheet P conveyed by the toner image receiving body 14*a* is separated by neutralizing operation of the sheet separation AC neutralizing unit 14*h* or by a curve of the driving roller 14*d*, the recording sheet P is slightly bent toward the toner image receiving body 14*a* by electrostatic adhesion between the toner image receiving body 14*a* and the recording sheet P. It is therefore preferable that conveyance section 160 having spurred wheels 162 is provided, and a leading edge of the recording sheet P is scooped up by the spurred wheels 162 to be guided to fixing unit 17, as shown in FIG. 6.

When the transfer material separated from the intermediate transfer body is scooped up by the spurred wheels and is guided to the fixing unit as stated above, the transfer material can be conveyed properly to the fixing means without disturbance of toner images for a reverse side image on the transfer material.

As described in the explanation for the embodiment mentioned above, sheet separation AC neutralizing unit 14*h* representing a transfer material separating means does not necessarily need to be provided, and the invention can also be applied to those wherein separation by a curve of driving roller 14*d* is employed as a separating method.

Figure 7:
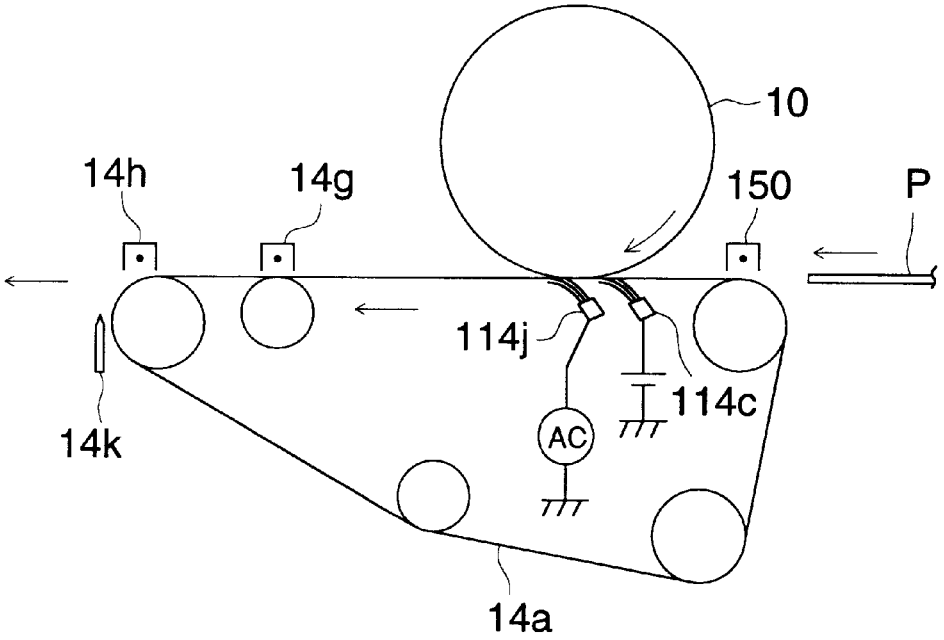
FIG. 7 is a diagram showing the second example of a neutralizing means for the first transfer means and the second transfer body.
Figure 8:
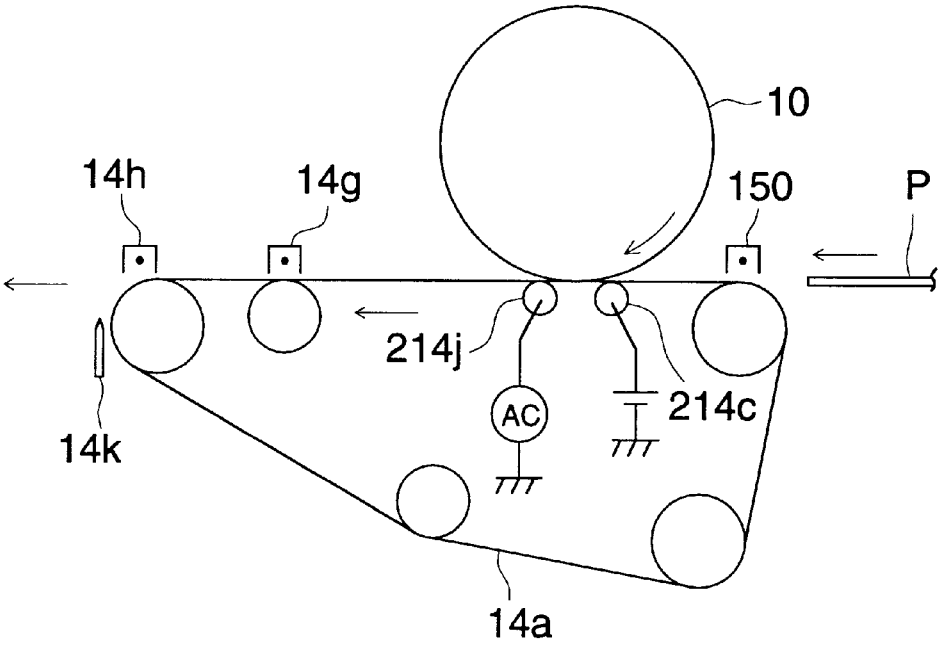
FIG. 8 is a diagram showing the third example of a neutralizing means for the first transfer means and the second transfer body.

Other examples of the first transfer means and an intermediate transfer body neutralizing means will now be explained with reference to FIGS. 7 and 8. FIG. 7 is a diagram showing the second example for each of the first transfer means and the intermediate transfer body neutralizing means, while FIG. 8 is a diagram showing the third example for each of the first transfer means and the intermediate transfer body neutralizing means.

In the second example shown in FIG. 7, brush-shaped transfer brush 114*c* is used in place of primary transfer unit 14*c* wherein a corona discharging unit serving as the first transfer means is used in the first example stated above, and brush-shaped toner image receiving body neutralizing brush 114*j* is used in place of toner image receiving body neutralizing unit 14*j* wherein a corona discharging unit serving as a neutralizing means is used.

The transfer brush 114*c* is provided to face photoreceptor drum 10 across toner image receiving body 14*a* and is impressed with DC voltage with polarity opposite to that of toner (positive polarity in the present embodiment) to transfer toner images on the photoreceptor drum 10 onto the toner image receiving body 14*a* or onto the surface of recording sheet P representing a transfer material.

The toner image receiving body neutralizing brush 114*j* representing an intermediate transfer body neutralizing means is provided at the downstream side of transfer brush 114*c* in the rotation direction of the toner image receiving body 14*a* to be in parallel with the transfer brush 114*c* to face the photoreceptor drum 10 across the toner image receiving body 14*a,* and it is impressed with AC voltage to neutralize the toner image receiving body 14*a.* Due to neutralizing operation of the toner image receiving body neutralizing brush 114*j,* electric charges (electric charges with positive polarity in the present embodiment) accumulated on the toner image receiving body 14*a* by volume resistivity of the toner image receiving body 14*a* representing a high resistance of $10^{10}$–$10^{16}\Omega\cdot$cm and by high voltage impression on the transfer brush 114*c* in the case of transfer of toner images on the photoreceptor drum 10 onto the toner image receiving body 14*a* or onto the recording sheet P are neutralized, and thereby toner images for a reverse side image on the toner image receiving body 14*a* can be transferred properly onto the recording sheet P in the course of transferring by secondary transfer unit 14*g* (third transfer step).

Through the image forming process mentioned above, superposed color toner images to be a reverse side image are formed on the photoreceptor drum 10 representing an image forming body, and the toner images to be a reverse side image thus formed on the photoreceptor drum 10 are collectively transferred, as the first transfer step, onto the toner image receiving body 14*a* representing a belt-shaped intermediate transfer body by transfer brush 114*c* representing the first transfer means which is impressed with voltage with polarity (positive polarity in the present embodiment) opposite to that of toner in the area where transfer brush 114*c* touches and the toner image receiving body 14*a* is neutralized by the toner image receiving body neutralizing brush 114*j* representing an intermediate transfer body.

As the second transfer step, toner images to be an obverse side image on the photoreceptor drum 10 are collectively transferred onto the surface of the recording sheet P by transfer brush 114*c* representing the first transfer means which is impressed with voltage with polarity (positive polarity in the present embodiment) opposite to that of toner, and the toner image receiving body 14*a* is neutralized by the toner image receiving body neutralizing brush 114*j* representing an intermediate transfer body.

In the foregoing, it is preferable that an absolute value of a transfer current for transfer brush 114*c* in the second transfer step to transfer toner images formed on the photoreceptor drum 10 onto the surface of recording sheet P conveyed by the toner image receiving body 14*a* is made to be greater than that of a transfer current for transfer brush 114*c* in the first transfer step to transfer toner images formed on the photoreceptor drum 10 onto the toner image receiving body 14*a.* As a transfer current for transfer brush 114*c* in the first transfer step, those of 10–200 $\mu$A (with positive polarity which is opposite to that of toner in the present embodiment) are usually used depending on the linear speed of the photoreceptor drum 10, and it is preferable to use a transfer current whose absolute value is 1.2–1.7 times that of the transfer current for transfer brush 114*c* in the first transfer step for transfer brush 114*c* in the second transfer step. In the case of less than 1.2 times, toner images to be an obverse side image are not properly transferred onto recording sheet P in the second transfer step, while in the case of 1.7 times or more, an electric current is too high and toner images for an obverse side image are disturbed. Further, since accumulated electric charges are increased with an increase of the transfer current, a neutralizing electric current for toner image receiving body neutralizing brush 114*j* after the second transfer step is made to be greater than that for toner image receiving body neutralizing brush 114*j* after the first transfer step.

The recording sheet P wherein color toner images are transferred onto the surface thereof is conveyed, as the second transfer step, to the second transfer unit 14*g* which is then impressed with voltage with polarity (positive polarity in the present embodiment) opposite to that of toner, as the third step, to collectively transfer onto the reverse side of the recording sheet P the toner images for a reverse side image formed, in the first transfer step, on the circumferential surface of the toner image receiving body 14*a,* thus two-sided images are formed.

Though AC voltage is impressed on the toner image receiving body neutralizing brush 114*j* for neutralizing the toner image receiving body 14*a* in the above explanation, it is also possible to ground the toner image receiving body neutralizing brush 114*j* for neutralizing the toner image receiving body 14*a.*

In the third example shown in FIG. 8, roller-shaped transfer roller 214*c* is used in place of the primary transfer unit 14*c* employing a corona discharging unit as the first transfer means in the first example, and roller-shaped toner image receiving body neutralizing roller 214*j* is used in place of the toner image receiving body neutralizing unit 14*j* employing a corona discharging unit as an intermediate transfer body neutralizing means.

The transfer roller 214*c* representing the first transfer means is provided to face the photoreceptor drum 10 across the toner image receiving body 14*a* and is impressed with DC voltage with polarity opposite to that of toner (positive polarity in the present embodiment) to transfer toner images on the photoreceptor drum 10 onto the toner image receiving body 14*a* or onto the surface of recording sheet P representing a transfer material.

The toner image receiving body neutralizing roller 214*j* representing an intermediate transfer body neutralizing means is provided at the downstream side of transfer roller 214*c* in the rotation direction of the toner image receiving body 14*a* to be in parallel with the transfer roller 214*c* to face the photoreceptor drum 10 across the toner image receiving body 14*a,* and it is impressed with AC voltage to neutralize the toner image receiving body 14*a.* Due to neutralizing operation of the toner image receiving body neutralizing roller 214*j,* electric charges (electric charges with positive polarity in the present embodiment) accumulated on the toner image receiving body 14*a* by volume resistivity of the toner image receiving body 14*a* representing a high resistance of $10^{10}$–$10^{16}\Omega\cdot$cm and by high voltage impression on the transfer roller 214*c* in the case of transfer of toner images on the photoreceptor drum 10 onto the toner image receiving body 14*a* or onto the recording sheet P are neutralized, and thereby toner images for a reverse side image on the toner image receiving body 14*a* can be transferred properly onto the recording sheet P in the course of transferring by secondary transfer unit 14*g* (third transfer step).

Through the image forming process mentioned above, superposed color toner images to be a reverse side image are formed on the photoreceptor drum 10 representing an image forming body, and the toner images to be a reverse side image thus formed on the photoreceptor drum 10 are collectively transferred, as the first transfer step, onto the toner image receiving body 14*a* representing a belt-shaped intermediate transfer body by transfer roller 214*c* representing the first transfer means which is impressed with voltage with polarity (positive polarity in the present embodiment) opposite to that of toner in the area where transfer roller 214*c* touches, and the toner image receiving body 14*a* is neutralized by the toner image receiving body neutralizing roller 214*j* representing an intermediate transfer body.

As the second transfer step, toner images for an obverse side image on the photoreceptor drum 10 are collectively transferred onto the surface of recording sheet P by transfer roller 214*c* representing the first transfer means on which voltage with polarity opposite to that of toner (positive polarity in the present embodiment) is impressed, and toner image receiving body 14*a* is neutralized by toner image receiving body neutralizing roller 214*j* representing an intermediate transfer body neutralizing means.

In the foregoing, it is preferable that an absolute value of a transfer current for transfer roller 214*c* in the second transfer step to transfer toner images formed on the photoreceptor drum 10 onto the surface of recording sheet P conveyed by the toner image receiving body 14*a* is made to be greater than that of a transfer current for transfer roller 214*c* in the first transfer step to transfer toner images formed on the photoreceptor drum 10 onto the toner image receiving body 14*a*. As a transfer current for transfer roller 214*c* in the first transfer step, those of 10–200 $\mu$A (with positive polarity which is opposite to that of toner in the present embodiment) are usually used depending on the linear speed of the photoreceptor drum 10, and it is preferable to use a transfer current whose absolute value is 1.2–1.7 times that of the transfer current for transfer roller 214*c* in the first transfer step for transfer roller 214*c* in the second transfer step. In the case of less than 1.2 times, toner images to be an obverse side image are not properly transferred onto recording sheet P in the second transfer step, while in the case of 1.7 times or more, an electric current is too high and toner images for an obverse side image are disturbed. Further, since accumulated electric charges are increased with an increase of the transfer current, a neutralizing electric current for toner image receiving body neutralizing roller 214*j* after the second transfer step is made to be greater than that for toner image receiving body neutralizing roller 214*j* after the first transfer step.

The recording sheet P wherein color toner images are transferred onto the surface thereof is conveyed, as the second transfer step, to the second transfer unit 14*g* which is then impressed with voltage with polarity (positive polarity in the present embodiment) opposite to that of toner, as the third step, to collectively transfer onto the reverse side of the recording sheet P the toner images for a reverse side image formed, in the first transfer step, on the circumferential surface of the toner image receiving body 14*a,* thus two-sided images are formed.

Though AC voltage is impressed on the toner image receiving body neutralizing roller 214*j* for neutralizing the toner image receiving body 14*a* in the above explanation, it is also possible to ground the toner image receiving body neutralizing roller 214*j* for neutralizing the toner image receiving body 14*a*.

Due to the invention, discharge interference between the first transfer means and the second transfer means and discharge interference between a transfer material separating means and the second transfer means are prevented, and electric charges on an intermediate transfer body caused by the second transfer means are leaked before they arrive at the separation position, thus, separation of a transfer material is stabilized. In addition, transferring of reverse side toner images conducted by the second transfer means is not affected by how a transfer material is separated from an intermediate transfer body, whereby toner images are transferred stably onto the reverse side of the transfer material from the intermediate transfer body.

By setting a value of volume resistivity of an intermediate transfer body within a prescribed range, and by providing a conductive rotary roller at each of the position to face the second transfer means and the position of separation, it is possible to achieve stable transferring of reverse side images conducted by the second transfer means and stable separation at the separation position, without damage of the intermediate transfer body.

Electric charges on the intermediate transfer body caused by the second transfer means are leaked before they arrive at the separation position, resulting in stable separation of a transfer material.

A transfer material conveyed by an intermediate transfer body and then is separated is scooped up by spurred wheels to be conveyed to a fixing means properly without any disturbance of toner images on the transfer material.

A transfer material can be separated easily at the separation position.

Image troubles which are created by disturbed toner images for a reverse side image caused when the toner images for a reverse side image formed on an image forming body are transferred onto an intermediate transfer body, and by disturbed toner images for an obverse side image caused when the toner images for an obverse side image formed on an image forming body are transferred onto the surface of a transfer material which is conveyed by an intermediate transfer body, are prevented, and damage of the intermediate transfer body caused by arcing which takes place when toner images for a reverse side image on the intermediate transfer body are transferred onto a reverse side of the transfer material in the third transfer step is prevented, and further, toner images for a reverse side image are transferred properly.

Transferring of toner images formed on an image forming body onto the surface of a transfer material and neutralizing are properly conducted.

What is claimed is:

1. An apparatus for forming toner images on both sides of a sheet, comprising:

a rotatable image forming body;

a toner image forming device for forming the toner images on the rotatable image forming body;

a rotatable intermediate transfer member onto which a toner image is transferred;

a first transfer device, located opposite the rotatable image forming body at a first transfer section, for transferring a toner image from the rotatable image forming body onto the rotatable intermediate transfer member or onto the first side of the sheet;

a second transfer device, located opposite the rotatable intermediate transfer member at a second transfer section, for transferring the toner image from the rotatable intermediate transfer member onto the second side of the sheet;

a fixing device for fixing the toner image on the first side of the sheet and the toner image on the second side of the sheet simultaneously;

wherein the sheet is conveyed to the first transfer section and to the second transfer section by the rotatable intermediate transfer member, is separated at a separating section from the rotatable intermediate transfer member, and is brought into the fixing device, wherein the second transfer section is located between the first transfer section and the separating section, wherein a conductive roller is located opposite the second transfer device, and wherein a roller is provided at the separating section, and a distance L1 between the center of the roller and the center of the conductive roller satisfies the following formula:

$$20\ \text{mm} \leqq L1 \leqq 200\ \text{mm}.$$

2. The apparatus of claim 1, wherein the rotatable intermediate transfer member has a volume resistivity of $10^{10}$ to $10^{16}\Omega\cdot$cm.

3. The apparatus of claim 2, wherein the separating section comprises a sheet separating device for eliminating electric charge from the sheet.

4. The apparatus of claim 2, wherein spurred wheels are provided between the separating section and the fixing device.

5. An apparatus for forming toner images on both sides of a sheet, comprising:

a rotatable image forming body;

a toner image forming device for forming the toner images on the rotatable image forming body;

a rotatable intermediate transfer member onto which a toner image is transferred;

a first transfer device, located opposite the rotatable image forming body at a first transfer section, for transferring a toner image from the rotatable image forming body onto the rotatable intermediate transfer member or onto the first side of the sheet;

a second transfer device, located opposite the rotatable intermediate transfer member at a second transfer section, for transferring the toner image from the rotatable intermediate transfer member onto the second side of the sheet;

a fixing device for fixing the toner image on the first side of the sheet and the toner image on the second side of the sheet simultaneously;

wherein the sheet is conveyed to the first transfer section and to the second transfer section by the rotatable intermediate transfer member, is separated at a separating section from the rotatable intermediate transfer member, and is brought into the fixing device, wherein the second transfer section is located between the first transfer section and the separating section, wherein a conductive roller is located opposite the second transfer device, and wherein a distance L1 between the center of the roller and the center of the conductive roller, and a distance L2 between the center of the conductive roller and the first transfer device, satisfy the following formula:

$$20\ \text{mm} < L2 \text{ and } L1 \leqq L2.$$

6. The apparatus of claim 5, wherein L1 is not greater than 200 mm.

7. The apparatus of claim 6, wherein the separating section comprises a sheet separating device for eliminating electric charge from the sheet.

8. The apparatus of claim 6, wherein spurred wheels are provided between the separating section and the fixing device.

9. An apparatus for forming toner images on both sides of a sheet, comprising:

a rotatable image forming body;

toner image forming device for forming the toner images on the rotatable image forming body;

an endless belt-shaped rotatable intermediate transfer member onto which a toner image is transferred, the intermediate transfer member having a sheet receiving section at which a sheet is loaded on the intermediate transfer member such that a first side of the sheet is faced upward and a second side of the sheet is brought in contact with the intermediate transfer member and a sheet separating section at which the sheet is separated from the intermediate transfer member;

a first transfer device for transferring a toner image from the image forming body onto the intermediate transfer member or onto the first side of the sheet, the first transfer device being located opposite the image forming body at a first transfer section;

a second transfer device for transferring the toner image from the intermediate transfer member onto the second side of the sheet, the second transfer device being located outside the intermediate transfer member at a second transfer section;

a sheet separating device which eliminates electric charge from the sheet, the sheet separating device being located outside the intermediate transfer member at the sheet separating section;

the second transfer section being located between the first transfer section and the separating section so that the sheet is conveyed by the intermediate transfer member firstly to the first transfer section at which the toner image is transferred from the rotatable image forming body to the first side of the sheet, secondly to the second transfer section at which the toner image is transferred from the intermediate transfer member to the second side of the sheet and thirdly to the separating section at which the sheet is separated from the intermediate transfer member;

the second transfer device and the sheet separating device being spaced apart from each other, and each comprising a non-contact type electric discharge device so that the toner image on the first side of the sheet passes without contacting the second transfer device and the sheet separating device;

a conductive member located inside the intermediate transfer member at the second transfer section so that the discharge device of the second transfer device discharges toward the conductive member;

a conductive roller located inside the intermediate transfer member at the separating section so that the discharge device of the sheet separating device discharges toward the conductive roller; and a fixing device for receiving the separated sheet from the sheet separating section and fixing the toner image on the first side of the sheet and the toner image on the second side of the sheet simultaneously.

10. The apparatus of claim 9, wherein a charge eliminating device for eliminating electric charge from the rotatable intermediate transfer member is provided between the first transfer device and the conductive roller.

11. The apparatus of claim 10, wherein the rotatable intermediate transfer member has a volume resistivity of $10^{10}$ to $10^{16}\Omega\cdot$cm.

12. The apparatus of claim 11, wherein an absolute value of a transfer current of the first transfer device at a time of transferring the toner image from the rotatable image forming body onto the sheet is greater than an absolute value of a transfer current of the first transfer device at a time of transferring the toner image from the rotatable image forming body onto the rotatable intermediate transfer member.

13. The apparatus of claim 12, wherein a charge eliminating current value of the charge eliminating device during a time of eliminating electric charge from the rotatable intermediate transfer member after the toner image is transferred from the rotatable image forming body to the sheet is greater than a charge eliminating current value of the charge eliminating device during the time of eliminating electric charge from the rotatable intermediate transfer member after the toner image is transferred from the rotatable image forming body to the rotatable intermediate transfer member.

14. The apparatus of claim 9, wherein the conductive member comprises a conductive roller.

15. The apparatus of claim 9, wherein said conductive roller is spaced apart from said conductive member.

* * * * *